US007334788B2

(12) United States Patent
Sakamaki et al.

(10) Patent No.: US 7,334,788 B2
(45) Date of Patent: Feb. 26, 2008

(54) SHEET FEEDER FOR FEEDING RECORDING SHEETS WHILE SEPARATING THESE

(75) Inventors: Katsumi Sakamaki, Nakai-machi (JP); Kazuyuki Tsukamoto, Nakai-machi (JP); Shin Takeuchi, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 540 days.

(21) Appl. No.: 10/806,158

(22) Filed: Mar. 23, 2004

(65) Prior Publication Data

US 2004/0188919 A1 Sep. 30, 2004

(30) Foreign Application Priority Data

Mar. 24, 2003 (JP) ..... 2003-081646
Feb. 20, 2004 (JP) ..... 2004-044858

(51) Int. Cl.
*B65H 3/52* (2006.01)

(52) U.S. Cl. ..... 271/125; 271/122; 271/258.01

(58) Field of Classification Search ..... 271/110, 271/113, 121, 122, 125, 258.01
See application file for complete search history.

(56) References Cited

U.S. PATENT DOCUMENTS 5,172,900 A * 12/1992 Uno et al. ..... 271/125
6,565,079 B1 * 5/2003 Kakegawa et al. ..... 271/125
6,672,579 B2 * 1/2004 Araki et al. ..... 271/122
7,052,008 B2 * 5/2006 Mitsuya et al. ..... 271/122
7,234,695 B2 * 6/2007 Tsukamoto et al. ..... 271/122
2001/0020765 A1 * 9/2001 Araki et al. ..... 271/125
2005/0073088 A1 * 4/2005 Watase ..... 271/121
2005/0184447 A1 * 8/2005 Tsukamoto et al. ..... 271/109
2006/0186594 A1 * 8/2006 Mitsuya et al. ..... 271/262

FOREIGN PATENT DOCUMENTS

JP 01064930 A * 3/1989
JP A 2-158533 6/1990
JP A 8-21790 8/1996
JP A 9-67037 3/1997
JP A 10-17163 1/1998
JP 2001213540 A * 8/2001
JP A 2001-302008 10/2001

* cited by examiner

*Primary Examiner*—Patrick Mackey
*Assistant Examiner*—Michael C McCullough
(74) *Attorney, Agent, or Firm*—Oliff & Berridge, PLC

(57) ABSTRACT

A sheet feeder is provided, which includes: a sheet feed member and a separating member which form a nip portion by pressing each other, the separating member rotates following the sheet feed member when a first recording sheet is inserted into the nip portion, and rotates reversely when a second recording sheet is inserted while being stacked under the first recording sheet; a sheet detection unit which detects the recording sheet inserted into the nip portion; a direction detection unit which detects a rotation direction of the separating member; and a separating force adjusting unit which gradually increases a reverse rotation torque of the separating member from a initial torque after the sheet detection unit detects the recording sheet, and stops the increase of the reverse rotation torque to maintain the reverse rotation torque when the direction detection unit detects reverse rotation of the separating member.

16 Claims, 8 Drawing Sheets

SHEET FEEDER FOR FEEDING RECORDING SHEETS WHILE SEPARATING THESE

FIELD OF THE INVENTION AND RELATED ART STATEMENT

The present invention relates to a sheet feeder provided to an image forming apparatus such as a copier, a facsimile, and a printer, which supplies recording sheets such as paper sheets to an image output unit or an image reading unit while separating the recording sheets one by one.

JP 2-158533 A discloses a system which feeds recording sheets loaded on a sheet feed tray while separating the recording sheets one by one. In this system, a pickup roll is brought into contact with the uppermost recording sheet among the recording sheets loaded on the sheet feed tray, and the recording sheet is fed out of the sheet feed tray by rotation of the pickup roll as described above. Then, a leading end of this recording sheet is plunged into a nip portion formed between the sheet feed roll and the separating roll. The sheet feed roll rotates in the same direction as that of the pickup roll, that is, in a direction of feeding the recording sheet further forward. Meanwhile, to the separating roll, the rotation torque in the reverse direction to the feeding direction of the recording sheet is applied through a torque limiter, and the separating roll is pressed against the sheet feed roll.

When the separating roll directly contacts with the sheet feed roll (when no recording sheet is present in the nip portion), and when only one recording sheet is present in the nip portion, a rotation torque exceeding a limit value of the torque limiter is applied from the sheet feed roll to the separating roll, and the separating roll as described above rotates following the sheet feed roll. Thus, when the rotation of the above-described pickup roll plunges only one recording sheet into the nip portion between the sheet feed roll and the separating roll, the recording sheet is fed by the sheet feed roll, and the separating roll also rotates following the sheet feed roll.

On the other hand, when two or more recording sheets are fed into the nip portion between the sheet feed roll and the separating roll, the limit value of the above-described torque limiter exceeds frictional force between such stacked sheets, and the separating roll rotates in the reverse direction to the feeding direction of the recording sheets, and pushes back one or plural recording sheets on a lower side, which directly contact with the separating roll. Thus, while the uppermost recording sheet in contact with the sheet feed roll is fed by the rotation of the sheet feed roll, the recording sheets plunged erroneously into the nip portion together with the uppermost recording sheet as described above is returned toward the sheet feed tray by the rotation of the separating roll. As a result, double feeding of the recording sheets is prevented.

In such a system, if the value of the rotation torque in the reverse direction, which is applied from a motor to the separating roll, is larger than that of the feeding force with which the first recording sheet to be fed drags the second recording sheet, then the separating operation is applied between the first and second recording sheets, and only the first recording sheet is fed. Hence, it is necessary to accurately control the rotation torque in the reverse direction, which is applied to the separating roll. For this purpose, JP 2-158533 A discloses a system, in which a unit which detects output torque of the motor for driving the separating roll (hereinafter, referred to as a "separating motor") is provided, and the output torque of the separating motor is controlled to a constant value based on information detected by the unit as described above.

Moreover, the feeding force with which the first recording sheet drags the second recording sheet differs depending on the pressing force of the separating roll against the sheet feed roll and on the friction coefficient between the first and second recording sheets. Accordingly, in systems disclosed in JP 8-217290 A and JP 9-067037 A, the thicknesses of the recording sheets and the frictional coefficient therebetween are detected, and based on results of these detections, the reverse rotation torque imparted to the separating roll is adjusted. Thus, control is performed such that a push-back force given to the second recording sheet by the separating roll always exceeds the feeding force with which the first recording sheet drags the second recording sheet.

However, in these related arts, although the reverse rotation torque from the separating motor to the separating roll is adjusted to a level sufficient to prevent the double feeding, the torque is not adjusted to the minimum necessary level to prevent the double feeding. Moreover, the reverse rotation torque at a constant level is always transmitted from the separating motor to the separating roll for a while from a start of the feeding of the recording sheet to an end thereof. Hence, an excessive load is applied to the first recording sheet being fed by the sheet feed roll, and the recording sheet is fed against the load as described above. Therefore, there has been a problem in that extra electric power is required for driving the sheet feed roll as well as that paper dust is apt to be generated between the recording sheet, and the sheet feed roll and the separating roll. Moreover, there has been a problem in that the unit for detecting the output torque of the separating motor and a sensor for measuring the thickness and frictional coefficient of the recording sheets become required, so that manufacturing cost is increased by that amount.

OBJECT AND SUMMARY OF THE INVENTION

The present invention has been made in view of the above problems and provides a sheet feeder capable of securely preventing double feeding of recording sheets to be fed even if types and thicknesses of the recording sheets are changed, and capable of being implemented at low cost without applying an excessive load to a sheet feed roll or providing any special sensor.

In order to achieve the above, there is provided a sheet feeder, including:

a sheet feed member which feeds recording sheets;

a separating member which forms a nip portion by pressing against the sheet feed member, rotates following the sheet feed member when only one recording sheet to be fed is inserted into the nip portion, and rotates reversely when a double-fed recording sheet is inserted while being stacked under the recording sheet to be fed;

a sheet detection unit which detects that each recording sheet fed out of the sheet feed tray has been inserted between the sheet feed member and the separating member;

a direction detection unit which detects a change of a rotation direction of the separating member; and a separating force adjusting unit which gradually increases a reverse rotation torque of the separating member from a predetermined initial torque after the sheet detection unit detects the recording sheet, and stops the increase of the reverse rotation torque to maintain the reverse rotation torque when the direction detection unit detects reverse rotation of the separating member.

According to such a technical measure, the feeding-out member feeds out the recording sheets housed in the sheet feed tray, and the each recording sheet is inserted into the nip portion between the sheet feed member and the separating member. Then, the sheet detection unit detects the recording sheet. Working with this, the separating force adjusting unit gradually increases the reverse rotation torque of the separating member from a predetermined initial torque. Here, when only one recording sheet is inserted into the nip portion between the sheet feed member and the separating member, the separating member rotates following the separating member, and the recording sheet is normally fed by the sheet feed member.

On the other hand, in the case where a double-fed recording sheet other than the recording sheet to be fed is inserted into the nip portion in a stacked manner, at a point of time when the reverse rotation torque given to the separating member exceeds a frictional force applied between the recording sheet to be fed and the double-fed recording sheet, the separating member stops rotating following the sheet feed member, and starts rotating in a direction of pushing back the double-fed recording sheet to the sheet feed tray, that is, in a reverse direction. The direction detection unit detects a start of the reverse direction of the separating member. Accompanied with this, the separating force adjusting unit stops increasing the reverse rotation torque given to the separating member, and maintains the reverse rotation torque at that time. Thus, the separating member will be driven with a reverse rotation torque that is the minimum necessary to push back the double-fed recording sheet to the sheet feed tray. The double-fed recording sheet plunged into the nip portion while being stacked under the first recording sheet is fed back to the sheet feed tray, and double feeding of the recording sheets is prevented.

Specifically, according to the present invention, after the recording sheet fed out of the sheet feed tray is inserted into the nip portion, the rotation torque in the reverse direction, which is given to the separating member, is gradually increased. Then, at a point of time when the separating member starts rotating in the reverse direction, the rotation torque in the reverse direction is maintained constant. Accordingly, the separating operation for the recording sheets can be performed securely while giving the reverse rotation torque that is the minimum necessary to the separating member in accordance with thicknesses and frictional coefficients of the recording sheets and with degrees of abrasion of the sheet feed member and separating member. Hence, an excessive resistance force is prevented from being applied to the feeding of the recording sheets by the sheet feed member, and paper dust during the sheet feeding can be restricted from being generated. In addition, electric power necessary to drive the sheet feed member can also be suppressed, thus making it possible to achieve energy saving. Moreover, even if a special sensor for detecting thicknesses, frictional coefficients, and the like of the recording sheets is not used, various kinds of recording sheets set on the sheet feed tray can be flexibly coped with, thus also making it possible to improve reliability of a sheet feed operation.

BRIEF DESCRIPTION OF THE DRAWINGS

A preferred embodiment of the present invention will be described in detail based on the following drawings, wherein:

FIGS. 5A to 5D are explanatory views showing a fed state of recording sheets in the first control example, in which: FIG. 5A is a view showing a state where two recording sheets are plunged into a nip portion; FIG. 5B is a view showing a state where leading end portions of the recording sheets have reached a sheet sensor; FIG. 5C is a view showing a state where a separating roll starts reverse rotation; and FIG. 5D is a view showing a state where a second recording sheet has come out of the nip portion;

DETAILED DESCRIPTION OF THE PREFERRED EMBODIMENT

A sheet feeder according to an embodiment of the present invention will be described below in detail with reference to the accompanying drawings.

Figure 1:
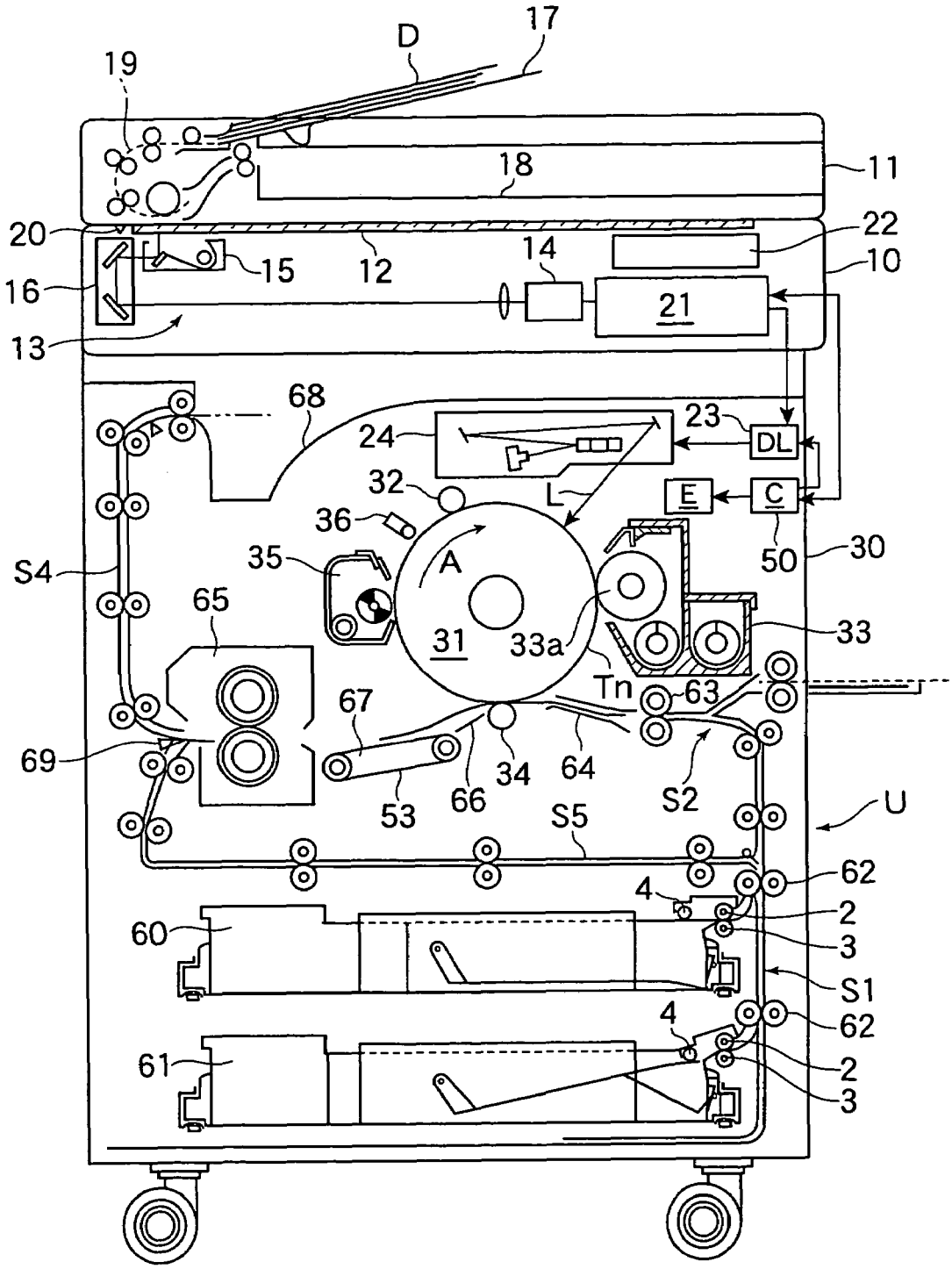
FIG. 1 is a configuration view schematically showing an example of a digital copier provided with a sheet feeder according to the present invention.

FIG. 1 is a longitudinal cross-sectional view of a digital copier in which the sheet feeder according to the embodiment of the present invention is applied to a feed mechanism. This copier U includes an image reading unit (IIT) 10 for optically reading an image of an original and converting the read image into image data as electric signals, and an image output unit (IOT) 30 for forming a recorded image on a recording sheet based on the image data. Further, an automatic original feeder 11 for continuously reading plural originals is attached to the image reading unit 10.

The image reading unit 10 includes platen glass 12 as an original table, and the automatic original feeder 11 functions as a platen cover for covering this platen glass 12. The image reading unit 10 includes an exposure optical system 13 under the platen glass 12, and a CCD sensor 14 that is a solid-state image pickup device. The image reading unit 10 is configured such that reflected light from each original D set on the platen glass 12 forms an image on an imaging surface of the CCD sensor 14 through the exposure optical system 13. The exposure optical system 13 includes a lamp carriage 15 for exposing/scanning an original image while moving along a lower surface of the platen glass 12, and a mirror carriage 16 for guiding reflected light from the original image to the CCD sensor 14. The exposure optical system 13 configures a minification optical system.

The automatic original feeder 11 includes an original feed tray 17 on which the plural originals D are loaded in a stacked manner, and an original discharge tray 18 for discharging originals that have been finished being read. The automatic original feeder 11 is configured such that the originals D pass through a reading position on the platen glass 12 on the way of an original feed path 19 from the original feed tray 17 to the original discharge tray 18.

The exposure optical system 13 includes a registration sensor 20 for detecting positions of the lamp carriage 15 and mirror carriage 16. Detection signals of the registration sensor 20 make it possible to set the respective carriages 15 and 16 at home positions shown in FIG. 1. In the case of a so-called ADF mode where original images are read by use of the automatic original feeder 11, the lamp carriage 15 and the mirror carriage 16 are set at the home positions, and the original images as described above are scanned while the originals D are being fed from the original feed tray 17 to the original discharge tray 18. Meanwhile, in the case of a so-called platen mode where a user performs copying work by placing the originals D on the platen glass 12 one by one without using the automatic original feeder 11, the lamp carriage 15 and the mirror carriage 16 scan the original images while moving under the platen glass 12. The reflected light obtained from the original images is made incident onto the CCD sensor 14, and converted into read image signals as electric signals by the CCD sensor 14.

Meanwhile, the copier U includes an image processing unit 21 provided in the image reading unit 10 or the image output unit 30, and a user interface 22 to which the user enters information regarding the copying work and the like or on which information regarding a state of the copier U and the like is displayed.

The image processing unit 21 converts the read image signals inputted from the CCD sensor 14 into digital image writing signals, and outputs the converted signals to a laser drive signal output device 23 of the image output unit 30. The laser drive signal output device 23 outputs laser drive signals corresponding to the inputted image writing signals to a raster scan device (ROS) 24. Operations of the image processing unit 21, the laser drive signal output device 23, a power supply circuit E, and the like are controlled by a controller 50 composed of a computer.

A photosensitive drum 31 disposed below the raster scan device 24 rotates in a direction shown by arrow A. A surface of the photosensitive drum 31 is charged, for example, with a voltage of −700 V by a charging roll 32, and then exposed/scanned by a laser beam L emitted from the raster scan device 24. Thus, on the surface of the photosensitive drum 31, an electrostatic latent image, for example, with a voltage of −300 V corresponding to the image writing signals is formed.

Next, the surface of the photosensitive drum 31 on which the electrostatic latent image is written passes through an opposite position to a developing device 33. The developing device 33 includes two-component developer composed of toner and carriers. The developer as described above is magnetically adsorbed to a developing roll 33*a* and carried to an opposite position to the photosensitive drum 31, and the electrostatic latent image formed on the surface of the photosensitive drum 31 is developed by the toner discharged in a negative polarity. Thus, a toner image Tn obtained by visualizing the electrostatic latent image is formed on the surface of the photosensitive drum 31.

The surface of the photosensitive drum 31, on which the toner image Tn is formed in such a manner, then travels to a transfer position of the toner image Tn, which faces a feed path of recording sheets P. At this transfer position, a transfer roll 34 is disposed so as to contact with the photosensitive drum 31. To the transfer roll 34, a transfer voltage with a polarity reverse to the charge polarity of the toner is supplied from a power supply circuit E, and the toner image Tn is transferred to the recording sheets P by a transfer electric field formed between the photosensitive drum 31 and the transfer roll 34. Voltages such as a charge bias applied to the charging roll 32, a develop bias applied to the developing roll 33*a*, and a transfer bias applied to the transfer roll 34 are applied by the power supply circuit E.

In a lower portion of the image output unit 30, a first sheet feed tray 60 and a second sheet feed tray 61 are arranged vertically. Above right end portions of the first and second sheet feed trays 60 and 61, pickup rolls 4 as sending-out members are arranged. The recording sheets P sent out from the respective sheet feed trays 60 and 61 by the pickup rolls 4 are fed to a first sheet feed path S1 through sheet feed mechanisms 1 provided on right sides of the sheet feed trays 60 and 61.

Each of the sheet feed mechanisms 1 includes a sheet feed roll 2 as a sheet feed member, a separating roll 3 as a separating member pressed against the sheet feed roll 2 to form a nip portion N, and the pickup roll 4. The recording sheets P fed to the nip portion N are separated one by one by an operation of the sheet feed mechanism 1, and are sent out to the first sheet path S1. The first sheet feed path S1 is extended vertically along a right side surface of the image output unit 30, and on the first sheet feed path S1 as described above, sheet feed rolls 62 are arranged. The sheets P sent out to the first sheet feed path S1 are fed to a second sheet feed path S2 immediately before the transfer position of the toner image Tn by the sheet feed rolls 62.

On the second sheet feed path S2, registration rolls 63 are arranged. The recording sheets P fed from the first sheet feed path S1 abut on the stopping registration rolls 63 to be engaged therewith temporarily, and thus skew of the recording sheets, which occurs during the feed, is removed. The registration rolls 63 start to rotate at predetermined timing in synchronization with timing when the toner image Tn moves to the transfer position, and the recording sheets P are fed to the transfer position through a pre-transfer sheet guide 64. Thus, the toner image can be transferred to predetermined positions on the recording sheets P.

After transferring the toner image Tn to the recording sheets P, the surface of the photosensitive drum 31 is cleaned by drum cleaner 35, and untransferred residual toner is removed from the surface of the photosensitive drum 31. Moreover, the surface of the photosensitive drum 31 after the cleaning is evenly exposed by a charge eliminating lamp 36, and a potential history thereon is deleted. Thereafter, the surface is recharged by the charging roll 32, and the next toner image Tn is then formed through the same process.

The recording sheets P to which the toner image Tn has been transferred is fed to a fixing device 65 through a third sheet feed path S3. In the third sheet feed path S3, there are provided a sheet guide 66 for promoting a release, from the photosensitive drum 31, of the recording sheets P charged by the transfer of the toner image by eliminating charges from the recording sheets P, and a sheet feed belt 67 for delivering, to the fixing device 65, the recording sheets P to which the toner image has already been transferred.

The toner image Tn is heat-fixed while the recording sheets P fed to the fixing device 65 are passing through the fixing device 65. The recording sheets P having passed through the fixing device 65 pass through a sheet discharge path S4, and is then discharged to a sheet discharge tray 68 provided on an upper portion of the image output unit 30. A switching gate 69 is disposed at a connecting portion of the fixing device 65 and sheet discharge path S4. This switching gate 69 guides the recording sheets P having passed through the fixing device 65 selectively to any one of the sheet discharge path S4 and a connecting path for double-sided copy S5.

The connecting path for double-sided copy S5 connects the fixing device 65 and the first sheet feed path S1 to each other, and is configured to feed, to the first sheet feed path S1, the recording sheets P on which the toner image Tn has been fixed by the fixing device 65. In the case of such so-called double-sided copy in which a recording image is formed on both surfaces of each recording sheet P, the recording sheet P, on the first surface of which a toner image has been recorded, is guided to the connecting path for double-sided copy S5 by the switching gate 69. Then, the sheet feed rolls 62 provided on the sheet feed path S1 are reversed, and thus the recording sheet P is fed from a leading end thereof into the first sheet feed path S1 as described above. Thereafter, at a point of time when a trailing end of the recording sheet P completely enters the first sheet feed path S1, the sheet feed rolls 62 rotate reversely, and feed the recording sheet P described above into the second sheet feed path S2. In other words, in the copier of this embodiment, the first sheet feed path SI also serves as an inverter path for inverting the recording sheet P. The recording sheet P, on one surface of which the toner image has already been recorded, the recording sheet P having been resent to the second sheet feed path S2 as described above, is resent to the transfer position of the toner image Tn, where the toner image Tn is also transferred on the second surface of the recording sheet P in a similar manner to the first surface.

Figure 2:
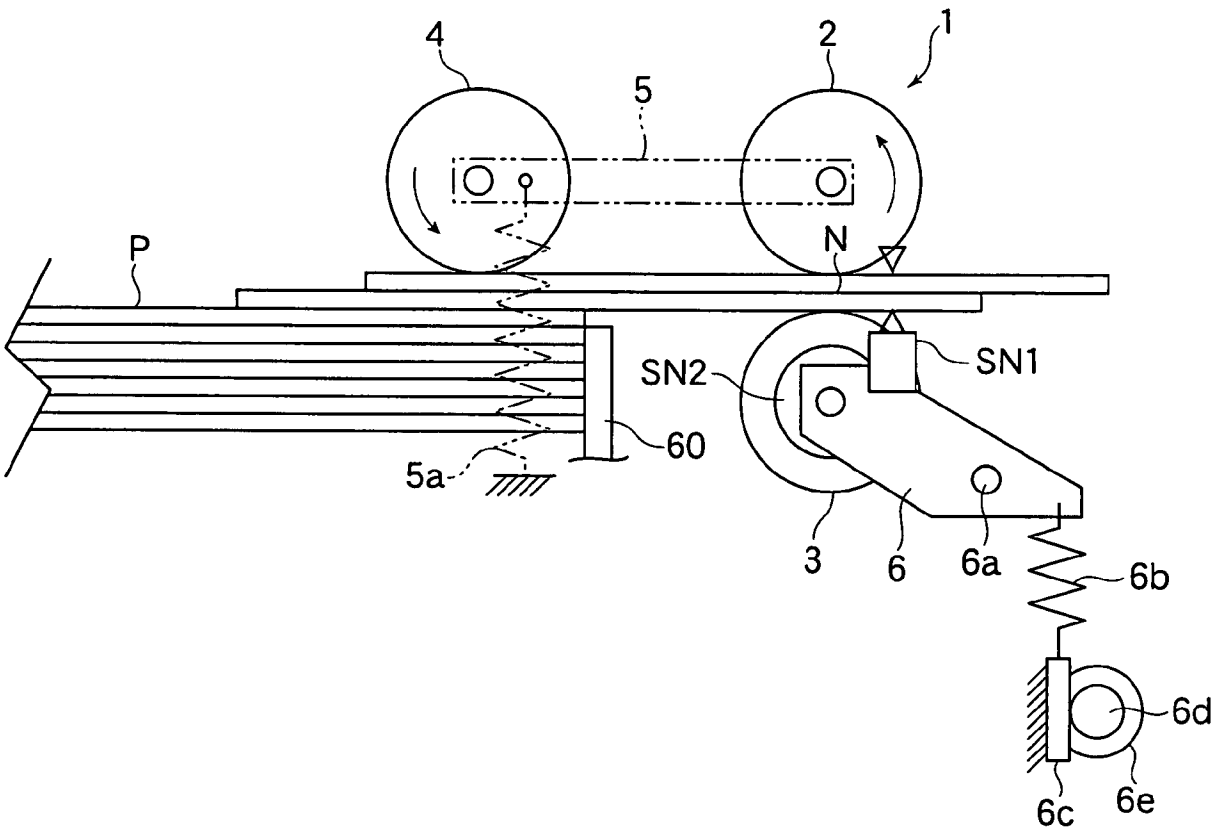
FIG. 2 illustrates an embodiment of a sheet feed mechanism to which the present invention is applied.

FIG. 2 is an explanatory view of the sheet feed mechanism 1. As mentioned above, this sheet feed mechanism 1 includes the sheet feed roll 2, the separating roll 3, and the pickup roll 4. The separating roll 3 is pressed against the sheet feed roll 2, and thus the nip portion N is formed therebetween. The sheet feed roll 2 and the pickup roll 4 are driven by the same sheet feed motor (not shown), and rotate in a direction of feeding the recording sheets P in the sheet feed tray 60 or 61 to the first sheet feed path S1.

Meanwhile, the separating roll 3 rotates by a separating motor (not shown) in a direction of returning the recording sheets P to the sheet feed tray 60 or 61. While the sheet feed motor gives a predetermined rotation torque to the sheet feed roll, it is possible to variably control the rotation torque of the separating motor, and the rotation torque to be given to the separating roll 3 is changed depending on a situation of feeding the recording sheets P in the nip portion N.

A rotation axis of the sheet feed roll 2 and a rotation axis of the pickup roll 4 are coupled to each other by a link lever 5, and the link lever 5 is configured to swing with the rotation axes as centers. The link lever 5 is biased downward by an extension spring 5*a*, and thus the pickup roll 4 presses the recording sheets P set in the sheet feed tray 60 or 61 from above. Moreover, in each of the sheet feed trays 60 and 61, a bottom plate (not shown) for elevating the recording sheets toward the pickup roll 4 is provided. The bottom plate is configured to stop rising when the uppermost recoding sheet in the sheet feed tray 60 or 61 contacts with the pickup roll 4, and when the link lever 5 is elevated to a predetermined height. Thus, the recording sheet P placed at the uppermost position in the sheet feed tray 60 or 61 is always pressed against the pickup roll 4 at substantially the same height.

When the sheet feed motor rotates, the pickup roll 4 rotates and feeds the uppermost recording sheet P in the sheet feed tray 60 or 61 to the nip portion N between the sheet feed roll 2 and the separating roll 3. The pickup roll 4 is coupled to the sheet feed motor with an electromagnetic clutch (not shown) being interposed therebetween, and incorporates a one-way clutch therein. After the leading end of the recording sheet P is inserted into the nip portion N, the pickup roll 4 is detached from the sheet feed motor by the electromagnetic clutch. Thus, the recording sheet P is fed by the rotation of the sheet feed roll 2. Moreover, the pickup roll 4 rotates following the feeding of the recording sheet P, and at a point of time when the trailing end of the recording sheet P finishes passing therethrough, the pickup roll 4 contacts with the next recording sheet and stops.

If the pickup roll 4 is pressed against the recording sheet P in the sheet feed tray 60 or 61 too much strongly, when the pickup roll 4 rotates, not only the uppermost recording sheet P in contact with the pickup roll 4, but also the second recording sheet P, which is dragged by the uppermost recording sheet, is fed out of the sheet feed tray 60 or 61 to the nip portion P. In order to prevent such double feeding of the recording sheets P, it is necessary to optimally adjust a pressing force of the pickup roll 4 against the recording sheets P in response to a type and the like of the recording sheets P set in the sheet feed trays 60 and 61. For this purpose, an adjustment mechanism for a biasing force of the extension spring 5*a* is provided though not being illustrated, thus making it possible to adjust the biasing force based on the occurrence frequency of the double feeding of the recording sheets P.

Meanwhile, a rotation axis of the separating roll 3 is supported by a pivot arm 6 swingable about a support axis 6*a*. The separating roll 3 is supported on one end of the pivot arm 6, and to the other end of the pivot arm 6, an extension spring 6*b* for biasing the separating arm 6 downward is coupled. Thus the separating roll 3 is biased upward and pressed against the sheet feed roll 2. Moreover, a lower end of the extension spring 6*b* is connected to a rack 6*c* movable vertically. The rack 6*c* is configured to move up and down by rotation of a pinion 6*d*. The pinion 6*d* is rotationally driven by a motor 6*e* for adjusting nip pressure. Hence, by controlling an amount of rotation of the motor 6*e* for adjusting nip pressure, the biasing force of the extension spring can be changed, and thus it is made possible to freely adjust the pressing force of the separating roll 3 against the sheet feed roll 2, that is, the nip pressure in the nip portion N.

A sheet sensor SN1 is disposed in the downstream of the nip portion N, and set as being capable of detecting the leading end of the recording sheet P inserted between the sheet feed roll 2 and the separating roll 3. Specifically, if detection signals of the sheet sensor SN1 are checked, it can be determined whether or not the recording sheet P is present in the nip portion N. Moreover, a rotation direction sensor SN2 composed of a rotary encoder is provided on the rotation axis of the separating roll 3. By checking detection signals of the rotation direction sensor SN2, a change of the rotation direction of the separating roll 3 can be detected. In this embodiment, the rotary encoder is used for detecting the change in the rotation direction of the separating roll 3. However, it is also possible to replace the rotary encoder with, for example, a speed sensor which detects moving speed of the recording sheet P fed through the nip portion N.

Figure 3:
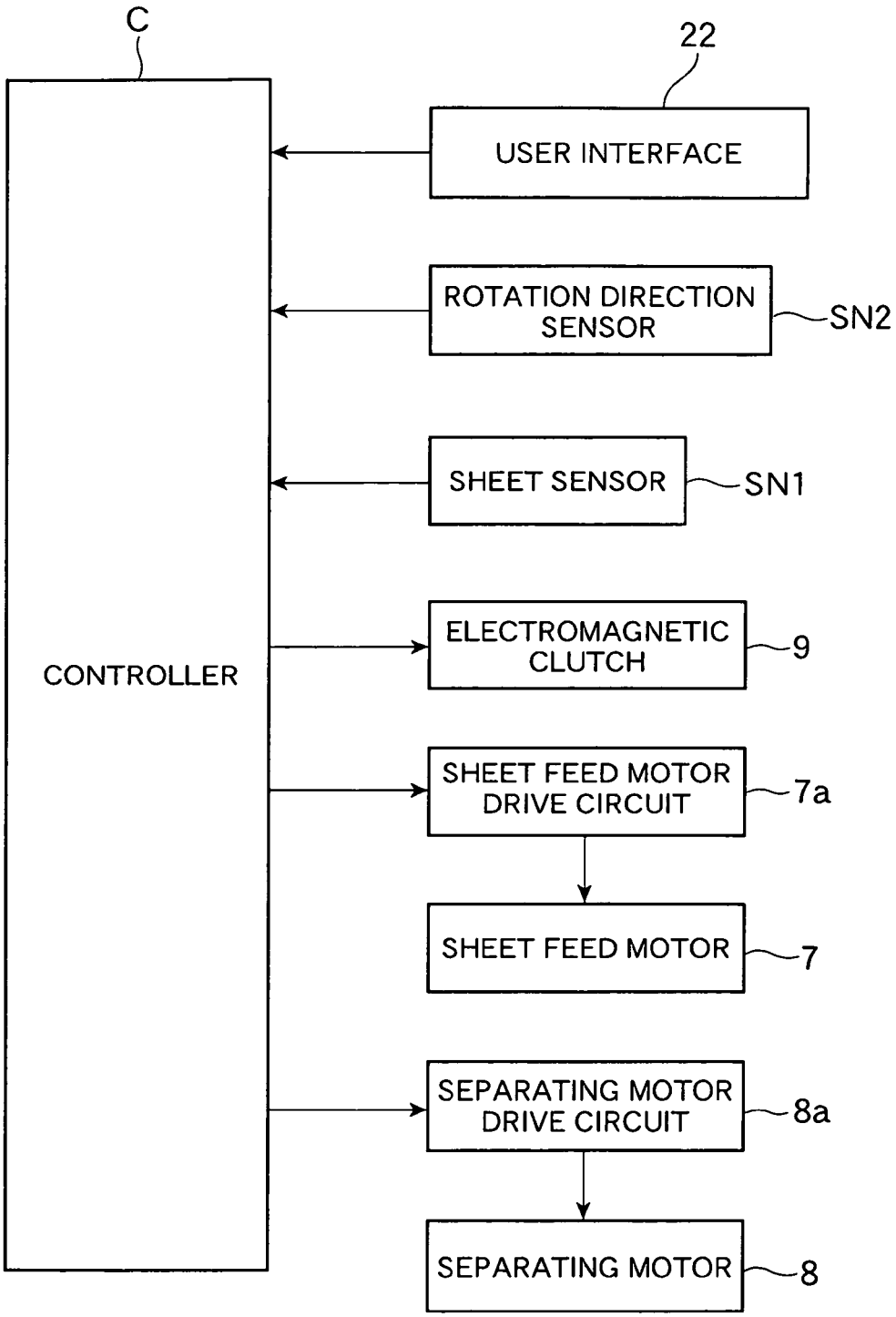
FIG. 3 is a block diagram showing a control system of the sheet feed mechanism according to an embodiment of the present invention.

FIG. 3 is a block diagram showing a control system of the sheet feed mechanism 1.

The controller C is composed of unillustrated components including: an input/output interface for inputting/outputting signals from/to the outside, adjusting levels of the inputted/outputted signals, and so on; a ROM (Read Only Memory) in which a program, data, and the like for performing necessary processing are stored; a RAM (Random Access Memory) for temporarily storing necessary data; a CPU (Central Processing Unit) performing processing in response to the program stored in the ROM; and a computer having a clock oscillator and the like. The controller C realizes various functions by executing programs stored in the ROM.

The user interface 22, the sheet sensor SN1, and the rotation direction sensor SN2 are connected to the controller C, and the controller C receives output signals from these instruments. Moreover, a drive circuit 7*a* of the sheet feed motor 7, a drive circuit 8*a* of the separating motor 8, and an electromagnetic clutch 9 coupling the sheet feed motor 7 and the pickup motor 4 to each other, are connected to the controller C. The controller C outputs control signals to these instruments. The sheet feed motor drive circuit 7*a* receives a control signal from the controller C to control the rotation and stop of the sheet feed motor 7. Moreover, the separating motor drive circuit 8*a* receives a control signal from the controller C to control the rotation and stop of the separating motor 8 and to control the rotation torque generated by the separating motor 8. Specifically, this controller C composes a separating force adjusting unit according to the present invention.

Figure 4:
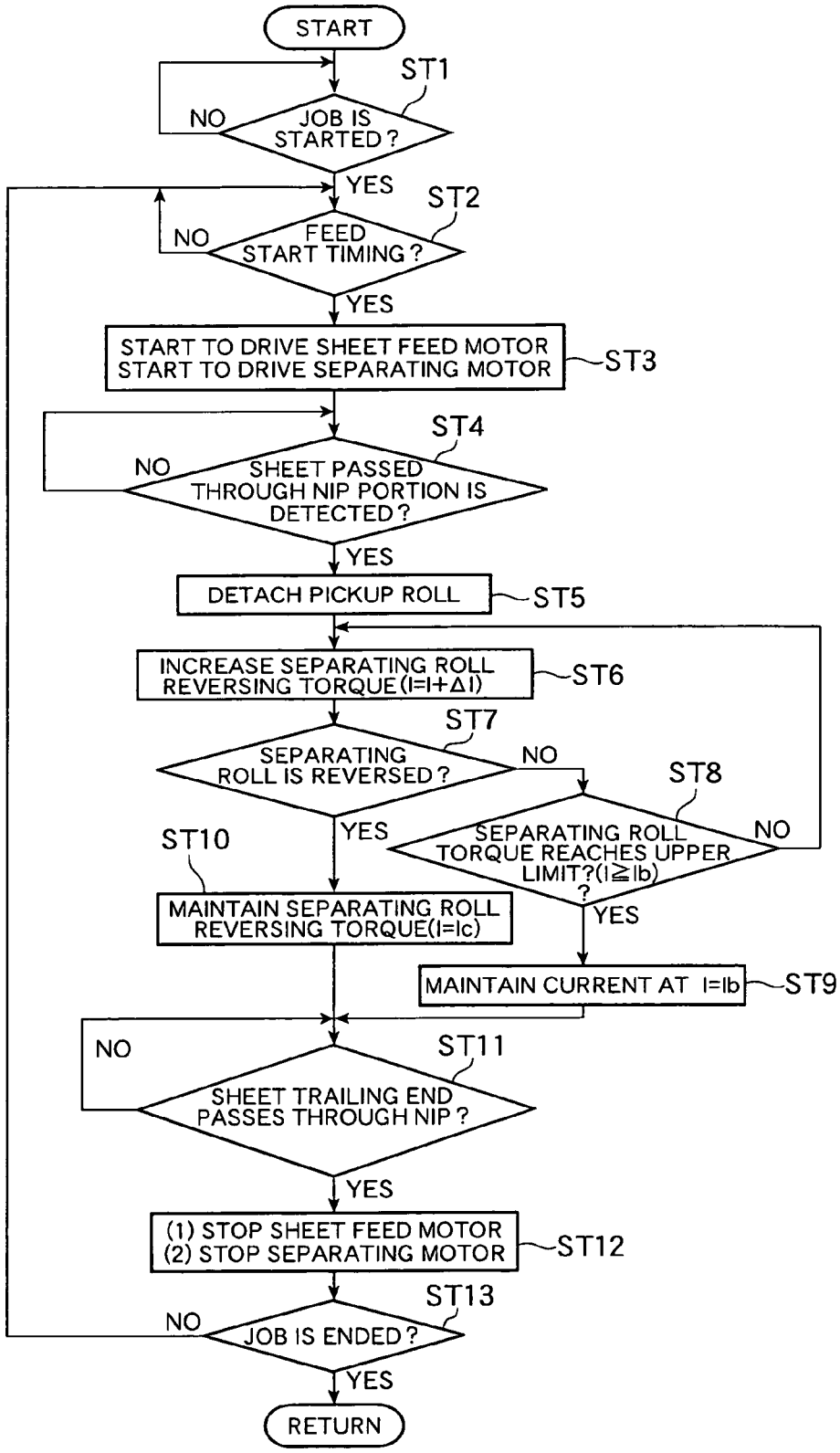
FIG. 4 is a flowchart showing a first control example of the sheet feed mechanism of the embodiment.

FIG. 4 is a flowchart showing a first control example for the sheet feed mechanism.

This control program is stored in the ROM of the controller C, and executed in the controller described above. In this control program, first, the controller C checks an output signal from the user interface 22 as to whether or not a copy button provided in an operation panel of the user interface 22 has been pressed, that is, whether or not a start of a copy job has been instructed (ST1). When it is determined that the start of the copy job has been instructed, it is checked whether or not sheet feed timing of feeding the recording sheet P has come (ST2). When it is determined that it is the sheet feed timing, the sheet feed motor drive circuit 7*a* is instructed to start driving the sheet feed motor 7, and the separating motor drive circuit 8*a* is instructed to start driving the separating motor 8 (ST3). Thus, the sheet feed motor 7 and the separating motor 8 start rotating.

Figure 5A:
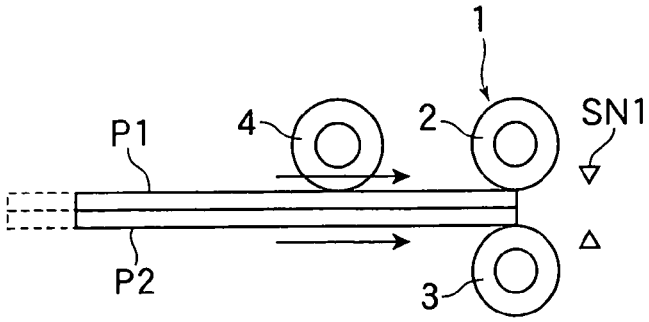

FIGS. 5A to 5D are schematic views showing states of feeding the recording sheets P in this sheet feed mechanism. When the sheet feed motor 7 starts driving, the sheet feed roll 2 and the pickup roll 4 start rotating. Then, the uppermost recording sheet P1 among the recording sheets P set in the sheet feed tray 60 or 61 is fed out from the sheet feed tray 60 or 61 by the pickup roll 4, and fed into the nip portion N where the sheet feed roll 2 and the separating roll 3 are pressed against each other (FIG. 5A). If the pressing force of the pickup roll 4 against the recording sheet P1 is suitable, only the uppermost recording sheet P1 in the sheet feed tray 60 or 61 is plunged into the nip portion N. However, here, for the sake of explaining a motion of the separating roll 3 in the sheet feed operation, description will be made for the case where the second recording sheet P2 is erroneously plunged into the nip portion N while being dragged by the uppermost recording sheet P1. Hence, also in FIG. 5A, the two recording sheets P1 and P2 are plunged into the nip portion N in a stacked state.

Figure 6:
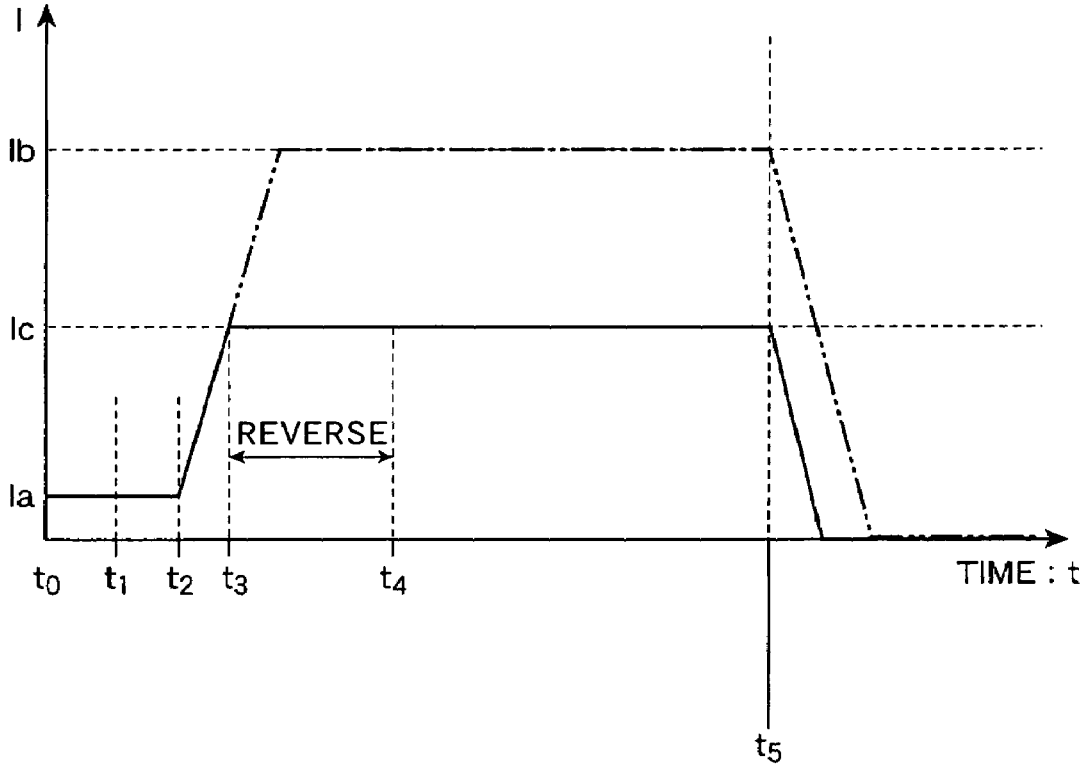
FIG. 6 is a timing chart showing fluctuations of a drive current of a separating motor according to the embodiment.

FIG. 6 is a timing chart showing fluctuation of a drive current caused to flow from the separating motor drive circuit 8*a* to the separating motor 8. In other words, FIG. 6 is a timing chart showing variation of the rotation torque applied to the separating roll 3 from the separating motor 8. At a time t0, the sheet feed motor 7 and the separating motor 8 start rotating, and after the time t1 elapses, the leading ends of the recording sheets P1 and P2 fed out of the sheet feed tray 60 or 61 by the pickup roll 4 are plunged into the nip portion N (refer to FIG. 5A).

Figure 5B:
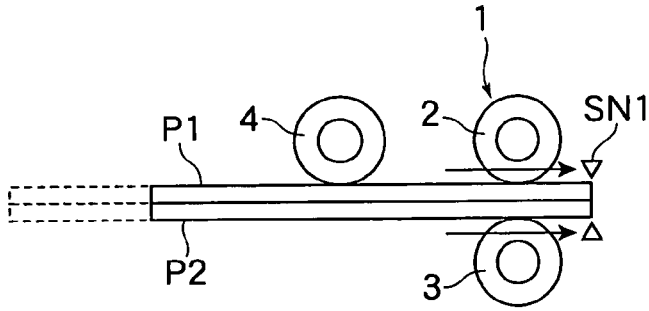
Figure 5C:
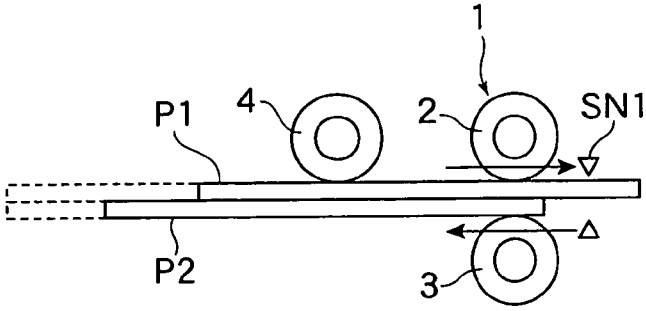

Next, the controller C checks the output signal from the sheet sensor SN1 as to whether or not the leading end of the recording sheet P1 fed out of the sheet feed tray 60 or 61 is inserted into the nip portion N between the sheet feed roll 2 and the separating roll 3 (ST4 of FIG. 4). The sheet sensor SN1 is provided downstream of the nip portion N in the direction of feeding the recording sheet P1. Accordingly, the change in the output signal from the sheet sensor SN1 means that, as shown in FIG. 5B, the leading end of the recording sheet P1 has been plunged into the nip portion N and has passed therethrough. When the controller C determines that the leading end portion of the recording sheet P1 has passed through the nip portion N based on the change in the detection signal of the sheet sensor SN1, the controller C sends out a control signal to the electromagnetic clutch 9, and detaches the pickup roll 4 from the sheet feed motor 7 (ST5). Thereafter, the pickup roll 4 rotates following the feeding of the first recording sheet P1. For the sake of convenience of explanation, timing when the output signal from the sheet sensor SN1 is changed is defined as t2.

As shown in FIG. 6, during a period from the time t0 to time t2, a drive current of the separating motor 8 is restricted to an extremely small current Ia, and a very little rotation torque in the direction reverse to the feeding direction of the recording sheet P1 is applied to the separating roll 3. Accordingly, when directly contacting with the sheet feed roll 2, the separating roll 3 rotates following the rotation of the sheet feed roll 2. Even after the recording sheets P1 and P2 are plunged into the nip portion N, the separating roll 3 rotates following the recording sheets P1 and P2 fed by the sheet feed roll 2.

When the sheet sensor SN1 detects the leading end portion of the recording sheet P1 at the time t2, the controller C instructs the drive circuit of the separating motor 8 to increase the drive current of the separating motor 8 by ΔI (ST6 of FIG. 4). Thus, the rotation torque of the separating roll 3 in the reverse direction is increased by an amount corresponding to ΔI. Subsequently, the controller monitors output signals from the rotation direction sensor SN2, and checks whether or not the rotation of the separating roll 3 has been reversed (ST7). When it is determined that the rotation has not been reversed, it is checked whether or not the drive current of the separating motor 8 has reached a predetermined upper limit value Ib. When it is determined that the drive current has not reached the upper limit value Ib, the controller further instructs that the drive current of the separating motor 8 is increased by ΔI (ST6).

As described above, the rotation torque in the reverse direction, which is applied to the separating roll 3, is increased, and this operation for the torque increase is repeated. In this case, in a state where the first recording sheet P1 and the second recording sheet P2 enter the nip portion N between the sheet feed roll 2 and the separating roll 3, the feeding force of the separating roll 3 for pushing back the second recording sheet P2 to the sheet feed tray 60 or 61 comes in the end to exceed the feeding force with which the first recording sheet P1 drags the second recording sheet P2. At this point of time of the exceeding, the separating roll 3 reverses its rotation direction, and comes to rotate in the direction reverse to the feeding direction of the sheet feed roll 2 for the recording sheet P1. This timing is defined as t3 (refer to FIG. 6). After the separating roll 3 starts the reverse rotation in such a way, the second recording sheet P2 that has been fed while being stacked under the first recording sheet P1 is pushed back toward the sheet feed tray 60 or 61 by the separating roll 3 (refer to FIG. 5C).

The controller C checks whether or not the rotation of the separating roll 3 has been reversed (ST7 of FIG. 4). When determining that the rotation has been reversed, the controller instructs the separating roll drive circuit 8*a* to stop the increase of the rotation torque of the separating motor 8 and to maintain the current rotation torque (ST10). Thus, as shown in FIG. 6, the drive current of the separating motor 3 is maintained at Ic from the time t3 forward. Which timing the separating motor 3 starts the reverse rotation at, in other words, which level the drive current of the separating motor 3 is increased to reverse the rotation of the separating roll 3 to, differs depending on size and type of the recording sheets P set in the sheet feed tray 60 or 61, and on the pressing force of the separating roll 3 against the sheet feed roll 2.

From the time t3 forward, the reverse rotation torque of the separating motor 8 is controlled at a constant value. As long as the second recording sheet P2 is inserted into the nip portion N, the separating roll 3 continues rotating in the reverse direction, and finally, the leading end portion of the second recording sheet P2 comes out of the nip portion N between the sheet feed roll 2 and the separating roll 3 (refer to FIG. 5D). This coming-out timing is defined as t4. However, after the second recording sheet P2 comes out of the nip portion N, the separating roll 3 directly contacts with the first recording sheet P1 being fed. The frictional force applied between the first recording sheet P1 and the separating roll 3 is larger than the frictional force between the first recording sheet P1 and the second recording sheet P2. Therefore, the separating roll 3 reverses its rotation direction and comes to rotate following the first recording sheet P1. Thus, the leading end portion of the second recording sheet P2 that has come out of the nip portion N may come to enter again the nip portion N.

In spite of the above, when the leading end portion of the second recording sheet P2 is plunged again into the nip portion N, the separating roll 3, to which the reverse rotation torque matched with the drive current Ic is continuously applied, reverses its rotation direction three times, and may push back the second recording sheet P2 toward the sheet feed tray 60 or 61. Specifically, from the time t4 forward, the separating roll 3 may reverse its rotation direction in response to whether the second recording sheet P2 comes out of or is plunged into the nip portion N, and in accordance with the change of the rotation direction, the second recording sheet P2 may come out of and be plunged into the nip portion N repeatedly. The first recording sheet P1 is fed by the sheet feed roll 2 even while the second recording sheet P2 repeats the motion as described above.

Meanwhile, consider a state where the recording sheet fed out of the sheet feed tray 60 or 61 by the pickup roll 4 is only the uppermost recording sheet P1, and where only the first recording sheet P1 is plunged into the nip portion N. In this state, the separating roll 3 directly contacts with the first recording sheet P1, and accordingly, unless the reverse rotation torque larger than the rotation torque of the sheet feed roll 2 is applied to the separating roll 3, the separating roll 3 is not reversed. Hence, if the separating roll 3 is not reversed even if the drive current of the separating motor 8 is increased more than a fixed level, it can be determined that only the first recording sheet P1 is plunged into the nip portion N, and that the double feeding of the recording sheets does not occur. For this purpose, in ST8 of FIG. 4, it is checked whether or not the drive current of the separating motor has reached the upper limit value Ib.

Hence, when it is determined in ST8 of FIG. 4 that the drive current of the separating motor 8 has reached the upper limit value Ib, it can be determined that the double feeding of the recording sheets has not occurred, and the drive current of the separating motor 8 is maintained at Ib without being increased more. Thus, an excessive load can be prevented from being applied during the feeding of the recording sheet P1 by the sheet feed roller 2.

When the first recording sheet has been fed to the first sheet feed path SH1 while preventing the double feeding in such a way, the controller C checks whether or not the trailing end of the first recording sheet P1 has come out of the nip portion N (ST11 of FIG. 4). When determining that the trailing end has come out, the controller C instructs the drive circuits 7*a* and 8*a* to stop the sheet feed motor 7 and the separating motor 8, respectively (ST12). This timing corresponds to a time t5 of FIG. 6. As a detection method for the point of time when the trailing end of the first recording sheet P1 comes out of the nip portion N, for example, conceivable are a method of detecting the point based on the change of the output signal from the rotation direction sensor SN2, and a method of counting by a timer a period in accordance with the size of the recording sheet from the time when the leading end of the first recording sheet P1 passes through the sheet sensor SN1. Thereafter, the controller C checks whether or not the copy job has ended (ST13). When it is determined that the job has not ended, the processing returns to ST2, from which the feeding of the recording sheets P is repeated.

According to this first control example of the sheet feed mechanism, only the minimum reverse rotation torque, which is necessary to prevent the double feeding of the recording sheets P, is supplied to the separating roll 3. In addition, the minimum reverse rotation torque in accordance with the type and size of the recording sheets P is applied thereto. Accordingly, the excessive feeding resistance can be prevented from being applied to the feeding of the first recording sheet by the sheet feed roll 2. Thus, it is possible to minimize electric power required for driving the sheet feed roll 2, and to reduce paper dust generated from the recording sheets P passing through the nip portion N.

Moreover, according to this first control example, when only one recording sheet P1 is plunged into the nip portion N between the sheet feed roll 2 and the separating roll 3, the separating roll 3 rotates following the feeding of the recording sheet P1, and accordingly, does not rotate in the reverse direction. The separating roll 3 makes the reverse rotation only when two or more recording sheets P are plunged into the nip portion. Therefore, when the separating roll 3 rotates reversely for a period from the time when the leading end of the recording sheet P1 is plunged into the nip portion till the drive current of the separating motor 8 reaches Ib, it is determined that the recording sheets P have been fed out of the sheet feed tray 60 or 61 to the nip portion N in a state where two or more recording sheets P are stacked.

Hence, when it is checked in ST7 of FIG. 4 whether or not the separating roll 3 has rotated reversely, results of the checking are stored in the RAM of the controller C, and the number of times the roll rotates reversely is counted. Thus, it is made possible to confirm frequency at which the double feeding of the recording sheets P has occurred with respect the accumulated number of sheets that have been fed for each of the sheet feed trays 60 and 61. Specifically, the controller C corresponds to an information collection unit of the present invention.

In addition, if the occurrence frequency of the double feeding of the recording sheets is counted by the controller C in such a way, it is made possible to appropriately adjust the biasing force of the extension spring pressing the pickup roller against the recording sheets by referring to results of the counting. This adjustment for the biasing force of the extension spring may be automatically performed by providing an actuator. Alternatively, through the user interface, a service engineer may read out information on the occurrence frequency of the double feeding, which is stored in the controller C, and may manually adjust the biasing force with reference to the read information on the occurrence frequency.

Figure 5D:
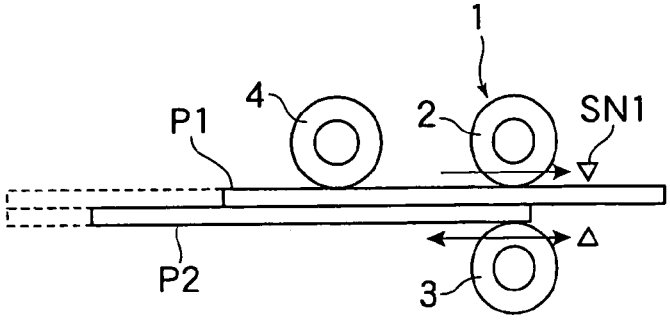

As described above, in the first control example, the separating roller 3 repeats the rotation following the feeding of the recording sheets and the rotation reverse thereto when the double feeding of the recording sheets P occurs. As shown in FIG. 5D, the second recording sheet P2 is engaged with the separating roll while the leading end thereof is coming out and is being plunged into the nip portion N repeatedly. Thus, the double feeding of the recording sheets P is prevented. However, so-called chattering occurs, in which the separating roll 3 makes such follower rotation as described above and the reverse rotation repeatedly at a small interval. Therefore, there is a fear that grating noise may occur, as well as vibrations due to the chattering may be applied to the copier. Moreover, since the separating roll 3 changes its rotation direction at a small interval in a state of being pressed against the first or second recording sheet P1 or P2, the paper dust is apt to adhere onto the separating roll 3. In this connection, it is anticipated that the frictional force applied between the separating roll 3 and the recording sheets P may be lowered under usage over time, with the result that the double-fed recording sheet P2 is more likely to fail to separate from the other sheet.

Figure 7:
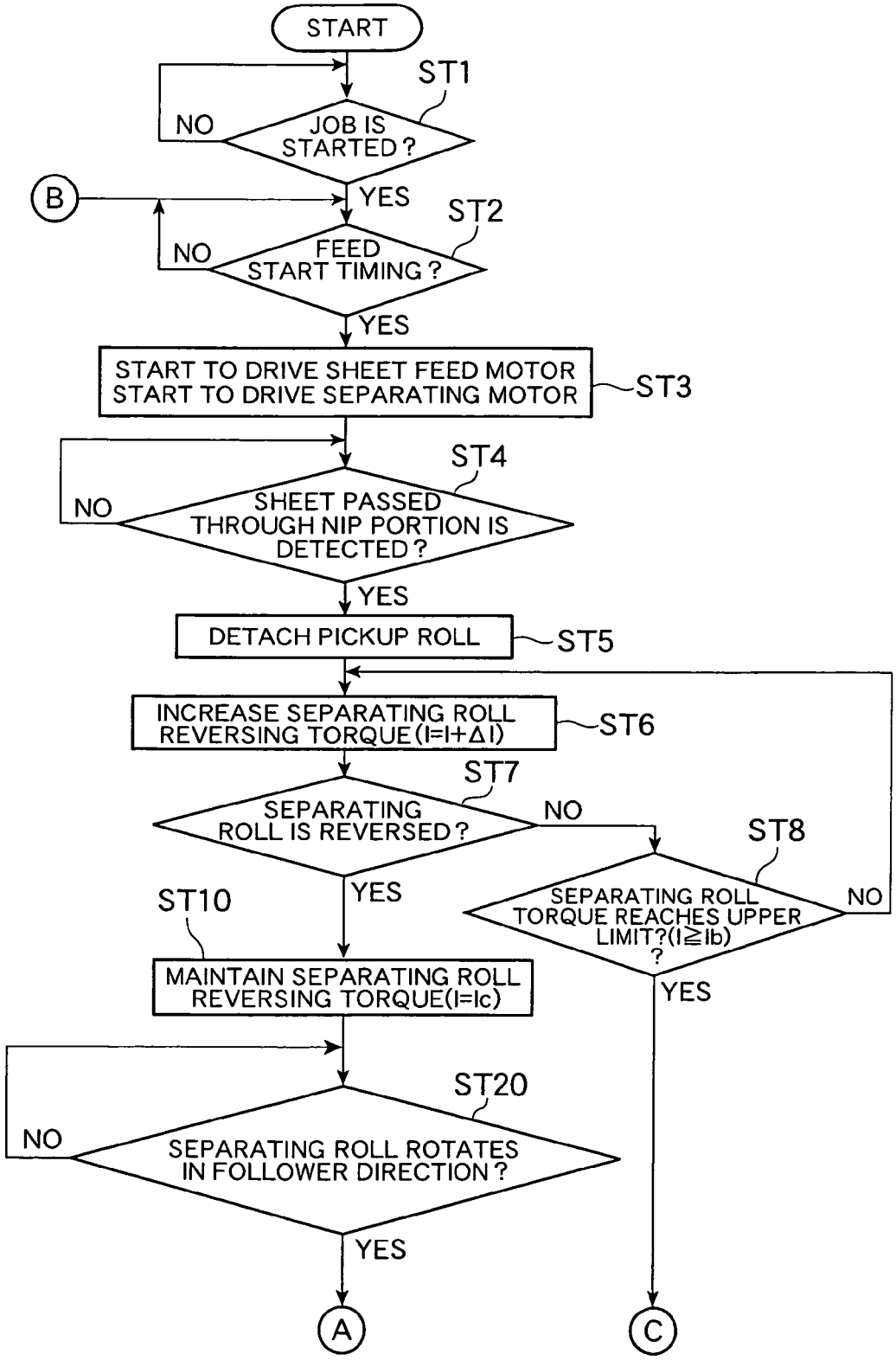
FIG. 7 illustrates a first half of a flowchart showing a second control example of the sheet feed mechanism of the embodiment.
Figure 8:
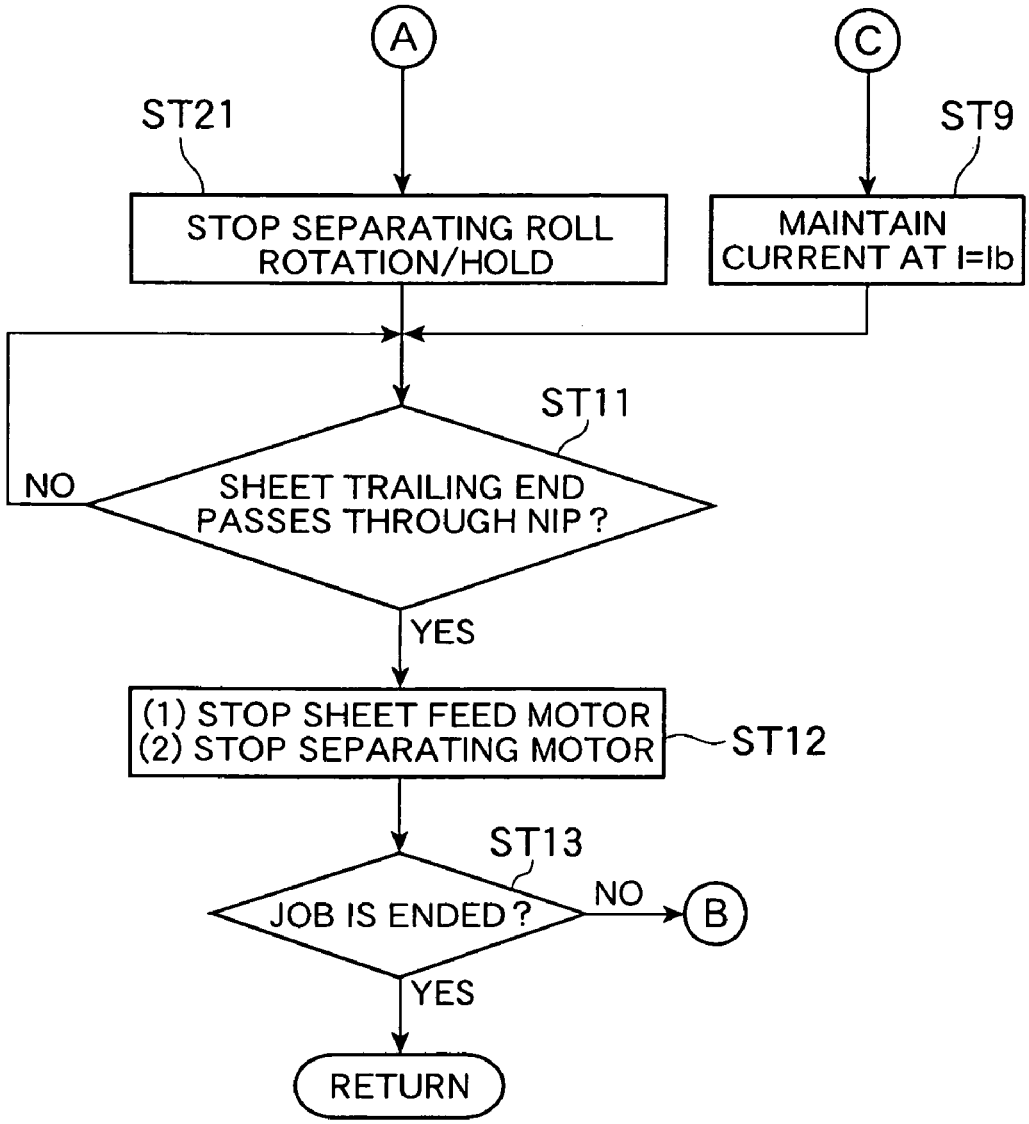
FIG. 8 illustrates a second half of the flowchart, the first half of which is illustrated in FIG. 7.

FIGS. 7 and 8 are flowcharts showing a second control example of the sheet feed operation in consideration of the points described above, where processing from ST1 to ST10 is the same as that of the first control example mentioned above. Here, description will be made of control after the separating roll 3 rotates reversely in ST7 and the drive current of the separating motor 8 is maintained at Ic at the time of the reverse rotation in ST10.

The fact that the separating roll 3 has rotated reversely in ST7 means that two recording sheets P1 and P2 are inserted in a stacked manner into the nip portion N between the sheet feed roll 2 and the separating roll 3. The separating roll 3 rotates reversely, thus the second recording sheet P2 is fed reversely toward the sheet feed tray 60 or 61, and the leading end of the second recording sheet P2 may come out of the nip portion N. Then, similarly to the first control example, when the leading end portion of the second recording sheet P2 comes out of the nip portion N, the separating roll 3 is brought into direct contact with the first recording sheet P1 being fed by the sheet feed roll 2. Therefore, the separating roll 3 reverses its rotation direction one more time to then rotate following the first recording sheet P1.

The controller C checks the output signal from the rotation direction sensor SN2 as to whether or not the rotation direction of the separating roll 3 has been changed from the reverse rotation direction to the feeding direction of the first recording sheet P1, that is, to the direction of the follower rotation (ST20). Then, when it is determined that the rotation direction of the separating roll 3 has been changed to the direction of the follower rotation, as shown in ST21 of FIG. 8, the controller C instructs the separating motor drive circuit 8*a* to stop the rotation of the separating motor 8 and to leave the separating roll 3 as it is without allowing the separating roll 3 to make the follower rotation or the reverse rotation.

The fact that the rotation direction of the separating roll 3 has been changed to the direction of the follower rotation in ST20 means that all of the double-fed recording sheets fed while being stacked under the first recording sheet have come out of the nip portion, and that only the leading end portion of the second recording sheet P2 is plunged again into the nip portion N. When the separating roll 3 stops based on the instruction from the controller C, the leading end portion of the second recording sheet P2 is in a state of being overlapped with the first recording sheet P1 and nipped into the nip portion (the same state as in FIG. 5C) For this reason, even if the separating roll 3 is forced to stop its rotation and kept being stopped, the first recording sheet P1 is fed by the sheet feed roll 2 while being slid on the second recording sheet P2. Meanwhile, the second recording sheet is engaged in a state where the leading end portion is inserted into the nip portion. Thus, the recording sheets double-fed to the nip portion are separated.

The following processing is the same as that of the first control example. The controller C checks whether or not the trailing end of the first recording sheet P1 has come out of the nip portion N (ST11). When determining that the trailing end has come out, the controller C instructs the drive circuits 7*a* and 8*a* to stop the sheet feed motor 7 and the separating motor 8, respectively (ST12). Thereafter, the controller C checks whether or not the copy job has ended (ST13). When it is determined that the job has not ended yet, the processing returns to ST2, from which the feeding of the recording sheets P is repeated.

According to this second control example, in the case of separating two recording sheets P1 and P2 double-fed from the sheet feed tray 60 or 61 in a stacked manner, the separating roll 3 does not cause the chattering, thus making it possible to prevent discomfortable vibration and noise from occurring. In addition, a large amount of paper dust can be prevented from adhering onto the surface of the separating roll 3 in the nip portion N. Furthermore, the recording sheets P erroneously double-fed can be separated stably for a long period of time.

As methods of stopping the rotation of the separating roll 3 in ST21 of FIG. 8, it is possible to adopt various methods in accordance with the type of the separating motor 8. For example, when the separating motor 8 is a DC servo motor, it is preferable that a level of the drive current be controlled to stop the separating motor 8 at a fixed position based on the output signal from the rotation direction sensor SN2. Moreover, when the separating motor 8 is a stepping motor, it is preferable that the stepping motor be made to exert holding power by conducting only the current to flow therethrough without inputting drive pulse signals thereto. In any case, the frictional force is applied between the first and second recording sheets P1 and P2 present in the nip portion N, and the first recording sheet P1 moves forward while dragging the second recording sheet P2. Therefore, it is necessary for the separating motor 8 to stop the rotation of the separating roll 3 against such feeding force of the first recording sheet P1.

Moreover, it is necessary to stop the rotation of the separating roll 3 after the leading end portion of the second recording sheet P2 is securely plunged into the nip portion N. From this point of view, after it is detected in ST20 of FIG. 7 that the rotation direction of the separating roll 3 has been reversed to the direction of the follower rotation, the processing in ST21, that is, the stop of the rotation of the separating roll 3 is performed soon, but the rotation of the separating roll 3 may be stopped after the elapse of a predetermined time. This predetermined time is a time required for the leading end portion of the second recording sheet P2 to be securely inserted into the nip portion N after the separating roll 3 starts rotating in the direction of the follower rotation.

In this second control example, it is determined that the leading end portion of the second recording sheet P2 has been inserted into the nip portion N while being overlapped with the first recording sheet P1 when the separating roll 3 that has rotated following the recording sheet P2 first starts rotating in the reverse direction and then starts rotating again in the follower direction. Specifically, the controller C that is checking the output signals from the rotation direction sensor SN2 corresponds to a double-feeding state determination unit in the present invention. However, the double-feeding state determination unit of the present invention is not limited to the above. For example, the following configuration can be adopted as well. A sensor for measuring the thickness of the recording sheets P inserted into the nip portion N is provided. Based on output signals from this sensor, it is determined whether or not the recording sheets P are double-fed in the nip portion N. Thus, the separating roll 3 is caused to stop rotating. This is because it can be determined based on the output signals from the thickness sensor how the recording sheets P are stacked in the nip portion if the thickness of one of the recording sheets P housed in the sheet feed tray 60 or 61 is grasped by the controller C in advance.

Note that no problem occurs even if the rotational sheet feed member and the rotational separating member in the present invention are in a roll shape or a belt shape as long as both of the members rotate in contact with the recording sheet.

What is claimed is:

1. A sheet feeder, comprising:

a sheet feed member which feeds recording sheets;

a separating member which forms a nip portion by pressing against the sheet feed member, rotates following the sheet feed member when only one recording sheet to be fed is inserted into the nip portion, and rotates reversely when a double-fed recording sheet is inserted while being stacked under the recording sheet to be fed;

a sheet detection unit which detects that each recording sheet fed out of a sheet feed tray has been inserted between the sheet feed member and the separating member;

a direction detection unit which detects a change of a rotation direction of the separating member; and a separating force adjusting unit which gradually increases a reverse rotation torque of the separating member from a predetermined initial torque after the sheet detection unit detects the recording sheet, and stops the increase of the reverse rotation torque to maintain the reverse rotation torque when the direction detection unit detects reverse rotation of the separating member.

2. A sheet feeder according to claim 1, wherein, when the reverse rotation torque of the separating member has reached a predetermined upper limit reverse rotation torque, the separating force adjusting unit maintains the upper limit reverse rotation torque.

3. A sheet feeder according to claim 1, wherein the separating force adjusting unit comprises:

a double-feeding state determination unit which detects that only one double-fed recording sheet has been inserted into the nip portion between the sheet feed member and the separating member while being overlapped with the recording sheet to be fed; and a holding unit which stops the separating member without allowing rotation thereof based on a detection result of the double-feeding state determination unit.

4. A sheet feeder according to claim 3, wherein the double-feeding state determination unit determines that the only one double-fed recording sheet has been inserted between the sheet feed member and the separating member when the rotation direction of the separating member has been changed from the reverse rotation direction to a follower direction.

5. A sheet feeder according to claim 3, wherein the holding unit adjusts, based on a detection signal of the direction detection unit, a size of a drive current of a motor which rotationally drives the separating member.

6. A sheet feeder according to claim 2, further comprising an information collection unit which counts frequency where the separating member starts the reverse rotation before reaching the upper limit reverse rotation torque with respect to the accumulated number of fed recording sheets and stores the counted number.

7. An image forming apparatus comprising:

an image output unit which forms a recorded image on each of recording sheets according to image data; and a sheet feeder which feeds the recording sheets to the image output unit, the sheet feeder including:

a sheet feed member which feeds the recording sheets;

a separating member which forms a nip portion by pressing against the sheet feed member, rotates following the sheet feed member when only one recording sheet to be fed is inserted into the nip portion, and rotates reversely when a double-fed recording sheet is inserted while being stacked under the recording sheet to be fed;

a sheet detection unit which detects that each recording sheet fed out of a sheet feed tray has been inserted between the sheet feed member and the separating member;

a direction detection unit which detects a change of a rotation direction of the separating member; and a separating force adjusting unit which gradually increases a reverse rotation torque of the separating member from a predetermined initial torque after the sheet detection unit detects the recording sheet, and stops the increase of the reverse rotation torque to maintain the reverse rotation torque when the direction detection unit detects reverse rotation of the separating member.

8. An image forming apparatus according to claim 7, wherein, when the reverse rotation torque of the separating member has reached a predetermined upper limit reverse rotation torque, the separating force adjusting unit maintains the upper limit reverse rotation torque.

9. An image forming apparatus according to claim 7, wherein the separating force adjusting unit comprises:

a double-feeding state determination unit which detects that only one double-fed recording sheet has been inserted into the nip portion between the sheet feed member and the separating member while being overlapped with the recording sheet to be fed; and a holding unit which stops the separating member without allowing rotation thereof based on a detection result of the double-feeding state determination unit.

10. An image forming apparatus according to claim 9, wherein the double-feeding state determination unit determines that the only one double-fed recording sheet has been inserted between the sheet feed member and the separating member when the rotation direction of the separating member has been changed from the reverse rotation direction to a follower direction.

11. An image forming apparatus according to claim 9, wherein the holding unit adjusts, based on a detection signal of the direction detection unit, a size of a drive current of a motor which rotationally drives the separating member.

12. An image forming apparatus according to claim 8, further comprising an information collection unit which counts frequency where the separating member starts the reverse rotation before reaching the upper limit reverse rotation torque with respect to the accumulated number of fed recording sheets and stores the counted number.

13. A method for preventing double feeding of recording sheets in a sheet feeder, the sheet feeder including:

a sheet feed member which feeds recording sheets; and a separating member which forms a nip portion by pressing against the sheet feed member, rotates following the sheet feed member when only one recording sheet to be fed is inserted into the nip portion, and rotates reversely when a double-fed recording sheet is inserted while being stacked under the recording sheet to be fed, the method comprising:

detecting that each recording sheet fed out of a sheet feed tray has been inserted between the sheet feed member and the separating member;

detecting a change of a rotation direction of the separating member;

gradually increasing a reverse rotation torque of the separating member from a predetermined initial torque after performing the detection of each recording sheet being inserted between the sheet feed member and the separating member; and stopping the increase of the reverse rotation torque to maintain the reverse rotation torque when reverse rotation of the separating member has been detected.

14. A method for preventing double feeding of recording sheets according to claim 13, further comprising, when the reverse rotation torque of the separating member has reached a predetermined upper limit reverse rotation torque, maintaining the upper limit reverse rotation torque.

15. A method for preventing double feeding of recording sheets according to claim 13, further comprising:

detecting that only one double-fed recording sheet has been inserted into the nip portion between the sheet feed member and the separating member while being overlapped with the recording sheet to be fed; and stopping the separating member without allowing rotation thereof based on a result of the detection.

16. A method for preventing double feeding of recording sheets according to claim 15, further comprising determining that the only one double-fed recording sheet has been inserted between the sheet feed member and the separating member when the rotation direction of the separating member has been changed from the reverse rotation direction to a follower direction.

* * * * *